US007487558B2

(12) United States Patent
Risk, Jr. et al.

(10) Patent No.: US 7,487,558 B2
(45) Date of Patent: Feb. 10, 2009

(54) HEADBOARD FOR A PULL-UP-IN-BED SYSTEM

(75) Inventors: James R. Risk, Jr., Fountaintown, IN (US); David W. Williams, Batesville, IN (US); Matthew C. Visca, Fairfield, OH (US); Peter M. Wukusick, Batesville, IN (US); James K. Findlay, Fishers, IN (US); Robert M. Zerhusen, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 238 days.

(21) Appl. No.: 11/314,426

(22) Filed: Dec. 21, 2005

(65) Prior Publication Data

US 2006/0162068 A1 Jul. 27, 2006

Related U.S. Application Data

(60) Provisional application No. 60/639,016, filed on Dec. 23, 2004.

(51) Int. Cl.
*A47C 17/00* (2006.01)

(52) U.S. Cl. ..... 5/53.1; 5/88.1; 5/280; 5/285

(58) Field of Classification Search ..... 5/53.1, 5/610, 83.1, 88.1, 216, 607, 280, 285
See application file for complete search history.

(56) References Cited

U.S. PATENT DOCUMENTS

| | | | | |
|---|---|---|---|---|
| 378,220 | A | 2/1888 | Staples et al. | |
| 716,886 | A | 12/1902 | Goode | |
| 1,085,879 | A * | 2/1914 | Skeppington | 5/88.1 |
| 1,263,611 | A | 4/1918 | Scroggin | |
| 2,528,048 | A | 10/1950 | Gilleland | |
| 2,536,707 | A | 1/1951 | Allyn | |
| 2,630,583 | A | 3/1953 | Gilleland | |
| 2,665,432 | A | 1/1954 | Butler | |
| 2,710,975 | A | 6/1955 | Stoen et al. | |
| 2,733,452 | A | 2/1956 | Tanney | |
| 2,812,524 | A | 11/1957 | Pruitt | |
| 2,827,642 | A * | 3/1958 | Huff | 5/88.1 |
| 3,108,290 | A | 10/1963 | Partridge | |
| 3,363,269 | A | 1/1968 | Kossuth | |
| 3,418,670 | A | 12/1968 | Morgan | |
| 3,562,824 | A | 2/1971 | White | |
| 3,597,774 | A | 8/1971 | Warren | |
| 3,750,199 | A | 8/1973 | Spivey | |
| 3,769,642 | A | 11/1973 | Warman | |
| 3,850,379 | A * | 11/1974 | Stern | 242/423.1 |
| 3,877,089 | A | 4/1975 | Spivey et al. | |
| 3,905,055 | A | 9/1975 | Blair | |

(Continued)

FOREIGN PATENT DOCUMENTS

| | | |
|---|---|---|
| EP | 0875228 | 4/1998 |

(Continued)

*Primary Examiner*—Patricia L Engle
*Assistant Examiner*—Emily M Morgan
(74) *Attorney, Agent, or Firm*—Barnes & Thornburg LLP

(57) ABSTRACT

An end panel for a patient support apparatus such as a hospital bed has a frame, a housing covering the frame, a roller mounted on the frame which rotates relative to the frame.

17 Claims, 5 Drawing Sheets

U.S. PATENT DOCUMENTS

| | | | | | |
|---|---|---|---|---|---|
| 4,077,073 | A | | 3/1978 | Koll | |
| 4,092,748 | A | | 6/1978 | Ewers | |
| 4,156,946 | A | | 6/1979 | Attenburrow | |
| 4,194,253 | A | | 3/1980 | Ullven | |
| 4,195,375 | A | | 4/1980 | Paul | |
| 4,202,063 | A | | 5/1980 | Murray | |
| 4,296,509 | A | | 10/1981 | Simmons et al. | |
| 4,459,712 | A | | 7/1984 | Pathan | |
| 4,536,903 | A | | 8/1985 | Parker | |
| 4,644,595 | A | | 2/1987 | Daniel | |
| 4,679,259 | A | | 7/1987 | DiMatteo et al. | |
| 4,680,818 | A | | 7/1987 | Ooka et al. | |
| 4,700,415 | A | | 10/1987 | DiMatteo et al. | |
| 4,726,082 | A | | 2/1988 | DiMatteo et al. | |
| 4,739,526 | A | | 4/1988 | Hollick | |
| 4,747,170 | A | | 5/1988 | Knouse | |
| 4,761,841 | A | | 8/1988 | Larsen | |
| 4,776,047 | A | | 10/1988 | DiMatteo | |
| 4,796,313 | A | | 1/1989 | DiMatteo et al. | |
| 4,819,283 | A | | 4/1989 | DiMatteo et al. | |
| 4,821,352 | A | | 4/1989 | DiMatteo et al. | |
| 4,837,872 | A | | 6/1989 | DiMatteo et al. | |
| 4,837,873 | A | | 6/1989 | DiMatteo et al. | |
| 4,868,938 | A | | 9/1989 | Knouse | |
| 4,887,325 | A | | 12/1989 | Tesch | |
| 4,941,220 | A | | 7/1990 | DiMatteo et al. | |
| 5,018,225 | A | | 5/1991 | Fergni et al. | |
| 5,038,424 | A | | 8/1991 | Carter et al. | |
| 5,054,140 | A | | 10/1991 | Bingham et al. | |
| 5,068,931 | A | | 12/1991 | Smith | |
| 5,072,840 | A | | 12/1991 | Asakawa et al. | |
| 5,080,950 | A | * | 1/1992 | Burke | 428/81 |
| 5,127,113 | A | | 7/1992 | DiMatteo et al. | |
| 5,168,587 | A | | 12/1992 | Shutes | |
| 5,239,713 | A | | 8/1993 | Toivio et al. | |
| 5,274,862 | A | | 1/1994 | Palmer, Jr. et al. | |
| 5,280,657 | A | | 1/1994 | Stagg | |
| 5,319,813 | A | | 6/1994 | DiMatteo et al. | |
| 5,379,468 | A | | 1/1995 | Cassidy et al. | |
| 5,390,379 | A | | 2/1995 | Palmer, Jr. et al. | |
| 5,406,658 | A | | 4/1995 | Olkkonen et al. | |
| 5,456,655 | A | | 10/1995 | Morris | |
| 5,469,588 | A | | 11/1995 | DiMatteo et al. | |
| 5,524,304 | A | | 6/1996 | Shutes | |
| 5,539,941 | A | | 7/1996 | Fuller | |
| 5,544,371 | A | | 8/1996 | Fuller | |
| 5,608,929 | A | * | 3/1997 | Crane | 5/81.1 R |
| 5,613,252 | A | | 3/1997 | Yu et al. | |
| 5,651,149 | A | | 7/1997 | Garman | |
| 5,659,905 | A | | 8/1997 | Palmer, Jr. et al. | |
| 5,673,443 | A | | 10/1997 | Marmor | |
| 5,697,109 | A | | 12/1997 | Hodgetts | |
| 5,720,685 | A | * | 2/1998 | Malone | 474/190 |
| 5,737,781 | A | * | 4/1998 | Votel | 5/81.1 HS |
| 5,819,339 | A | | 10/1998 | Hodgetts | |
| 5,850,642 | A | | 12/1998 | Foster | |
| 5,890,238 | A | * | 4/1999 | Votel | 5/81.1 HS |
| 5,901,388 | A | | 5/1999 | Cowan | |
| 5,937,456 | A | | 8/1999 | Norris | |
| 5,996,144 | A | | 12/1999 | Hodgetts | |
| 6,065,162 | A | | 5/2000 | Behr | |
| 6,282,734 | B1 | | 9/2001 | Holberg | |
| 6,289,533 | B1 | * | 9/2001 | Hodgetts | 5/81.1 R |
| 6,363,555 | B1 | | 4/2002 | LaRose | |
| 6,378,148 | B1 | | 4/2002 | Votel | |
| 6,496,991 | B1 | | 12/2002 | Votel | |
| 6,507,963 | B2 | | 1/2003 | Hodgetts | |
| 6,539,569 | B2 | | 4/2003 | O'Connell | |
| 6,591,435 | B1 | | 7/2003 | Hodgetts | |
| 6,615,423 | B2 | * | 9/2003 | Sverdlik et al. | 5/81.1 C |
| 6,629,323 | B2 | * | 10/2003 | Sverdlik et al. | 5/81.1 C |
| 6,662,388 | B2 | * | 12/2003 | Friel et al. | 5/86.1 |
| 6,772,456 | B2 | | 8/2004 | Votel | |
| 2001/0044957 | A1 | | 11/2001 | Hodgetts | |
| 2002/0029418 | A1 | * | 3/2002 | Votel | 5/81.1 RP |
| 2002/0083521 | A1 | | 7/2002 | Sverdlik et al. | |
| 2002/0083522 | A1 | | 7/2002 | Sverdlik et al. | |
| 2004/0181871 | A1 | * | 9/2004 | McMahan | 5/53.1 |
| 2005/0138727 | A1 | * | 6/2005 | Faux et al. | 5/81.1 R |
| 2006/0272884 | A1 | * | 12/2006 | Vilcek et al. | 181/198 |

FOREIGN PATENT DOCUMENTS

| | | |
|---|---|---|
| GB | 2139487 | 11/1984 |
| WO | 9521600 | 8/1995 |
| WO | 9709896 | 3/1997 |
| WO | 9844889 | 10/1998 |

* cited by examiner

HEADBOARD FOR A PULL-UP-IN-BED SYSTEM

RELATED APPLICATIONS

This application claims the benefit, under 35 U.S.C. § 119(e), of U.S. Provisional Patent Application Ser. No. 60/639,016 filed Dec. 23, 2004 which is hereby incorporated by reference herein in its entirety.

BACKGROUND OF THE INVENTION

The present disclosure relates to systems which assist with the movement of patients who are partially or completely incapacitated. More specifically, the disclosure is related to a system coupled to a patient support apparatus and configured to reposition a patient relative to the longitudinal length of the patient support apparatus.

From time to time, patients on a patient support apparatus such as a hospital bed who are partially or completely incapacitated need to be moved or repositioned. For example, in some cases, a patient may have slid down, slumped, or otherwise moved toward a foot end of the patient support apparatus, for example. This may result from inclination of a head section of the patient support apparatus and the patient may need to be repositioned toward the head end of the patient support apparatus when the head section is lowered back down. In other cases, a patient may need to be moved to a different bed.

In repositioning or moving a patient, a caregiver such as a nurse, for example, will grip the patient and pull, slide, or roll the patient to the new position. For larger patients, the caregiver may summon assistance from other nurses, assistants, orderlies, or the like. In some cases, a piece of fabric referred to as a draw-sheet may be positioned under the patient and used by the caregivers as an aid to repositioning the patient. The draw-sheet may be gripped by the caregiver(s) and used to lift and reposition the patient or the sheet may be pulled over the surface of the patient support apparatus to reposition the patient.

SUMMARY OF THE INVENTION

The present invention comprises one or more of the features recited in the appended claims or the following features or combinations thereof.

An end panel such as a headboard, for example, for use on a patient support apparatus having a pull-up-in-bed system is provided. The pull-up-in-bed system may comprise a retractor, a tether coupled to the retractor at a first end of the tether. The pull-up-in-bed system may further comprise a sheet attachment device coupled to a second end of the tether. The sheet attachment device may be configure to engage a sheet under a patient being repositioned. In use, the retractor may retract the tether which repositions the patient on the patient support apparatus. In some embodiments, the pull-up-in-bed system may be mounted to the frame of a hospital bed. In other embodiments, the pull-up-in-bed system may be mounted to a structure in a patient room such as a wall, an architectural headwall unit, or an equipment column, for example.

The end panel may comprise a frame, a bracket coupled to the frame, a roller supported for rotation by the bracket, and a housing encasing the frame and bracket. The housing may have an interior region. The end panel may further comprise structural foam at least partially filling the interior region of the housing. The end panel may have integrated depressions in the surface of the housing to provide additional stiffening of the end panel.

The end panel may further comprise a cavity for receiving and stowing a sheet attachment device of the pull-up-in-bed system. The cavity may be provided along the upper edge of the end panel. The housing may have two lugs on opposing sides of the cavity. The lugs may be received in two cavities or pockets provided in the sheet attachment device. The sheet attachment device may have at least one retaining pin which extends from the sheet attachment device beneath a lower edge of an associated one of the lugs so as to provide retention of the sheet attachment device on the end panel. The at least one retaining pin may be retracted by a user by activating a retraction mechanism which thereby withdraws the at least one retaining pin from beneath the lower edge of the associated lug, thereby permitting the sheet attachment device to be lifted upwardly and removed from the end panel. The end panel may have two retracting pins.

The frame of the end panel may comprise a U-shaped tubular member with legs of the U-shaped member extending downwardly. The tubular member may be a metal tube such as steel or aluminum. The tubular member may have a circular cross-section. The ends of the tubes may have apertures which are exposed at the bottom of the end panel. The bracket may be coupled to the frame at the upper portion. The bracket may have two leg portions which extend perpendicular to a main portion, with the main portion being coupled to the frame. In some embodiments, the bracket may comprise a sheet member. In some embodiments, the bracket may be made from metal such as steel or aluminum. In some embodiments, the leg portions may be secured to the main portion by welding or some other fastening process. The two leg portions may be parallel and each leg portion may have an aperture therethrough, the apertures being aligned to receive portions of one or more pins to support the roller. The shape of the apertures may be non-circular. The shape of the portions of the pins received by the apertures may also be non-circular. In some embodiments, engagement of the pins and apertures may resist rotation of the pins relative to the bracket.

The roller may be coupled to the bracket through two pins which extend from opposite ends of the roller and engage the non-circular apertures in the bracket. The roller may have a bore along the longitudinal axis of the roller. Two bushings may be located in the bore of the roller. The bushings may have an outer diameter sized to provide an interference fit with the bore of the roller. The inner diameter of the bushings may be sized to receive the two pins. The portions of the pins received by the bushings may be circular in cross section. The inner surface of the bushings may be configured to provide a bearing surface for the pins to facilitate rotation of the roller relative the pins. The portion of the pins extending from the bushings and engaging the non-circular apertures may have a complementary non-circular cross section received in the apertures, thereby preventing rotation of the pins within the apertures. A spring may be included within the bore of the roller, the spring retained between the pins within the bore. The spring may be an extension spring maintained in a state of compression between the pins to bias the pins to extend from the bore and engage the non-circular apertures in the bracket. In some embodiments, the bushings and spring may be omitted and the pins may be replaced by a single pin which extends through the roller with a non-circular cross-section on opposite ends to engage the non-circular apertures. Once assembled, the roller may be configured to rotate about it's longitudinal axis relative to the pin(s) which are held fixed by the bracket.

The roller may have an annular outer shape which includes annular flanges at opposite ends of the longitudinal length of the roller and a convex annular surface between the flanges. The convex annular surface may be a convex parabolic surface. The roller may be constructed of a plastic material such as Celcon® M-90 from General Electric or other similar material which has sufficient durability to withstand the loads transmitted thereto by a tether of a pull-up-in-bed system. In some embodiments, the roller may comprise two pieces coupled together over a single pin which extends through the bore along the longitudinal length of the roller. The roller may be situated in a notch formed in the housing beneath the cavity that receives the sheet attachment device of the pull-up-in-bed system.

The housing of the end panel may be a unitary piece of polypropylene or other similar material having sufficient strength and formability to form the housing. In some embodiments, the housing may be constructed of multiple pieces secured together through an adhesive or fastener. The tubular frame and metal bracket may be contained within the housing. Additional voids within the housing may be occupied by a structural foam. In some embodiments, the structural foam may be a polyurethane foam. It should be understood that any of a number of foam materials may be used to increase the load-bearing properties of the end panel.

The end panel may be mounted on a frame of the patient support apparatus. A mounting bracket may be used as an interface between the end panel and the frame. The mounting bracket may include mounting posts which extend from the frame and which are received in the apertures at the ends of the tube of the frame of the end panel. The frame of the patient support apparatus may have apertures sized to receive mounting posts located on the mounting bracket on the side of the mounting bracket opposite the mounting posts which engage the end panel. In use, the mounting bracket may be located on the frame of the patient support apparatus with mounting posts received in the apertures of the frame of the patient support apparatus and with the end panel mounted on the mounting bracket with the apertures of the end panel frame tube receiving additional mounting posts on the mounting bracket. Thus, lower portions of the frame of the end panel serve as sockets to receive posts of the mounting bracket.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which.

DETAILED DESCRIPTION OF THE DRAWINGS

Figure 1:
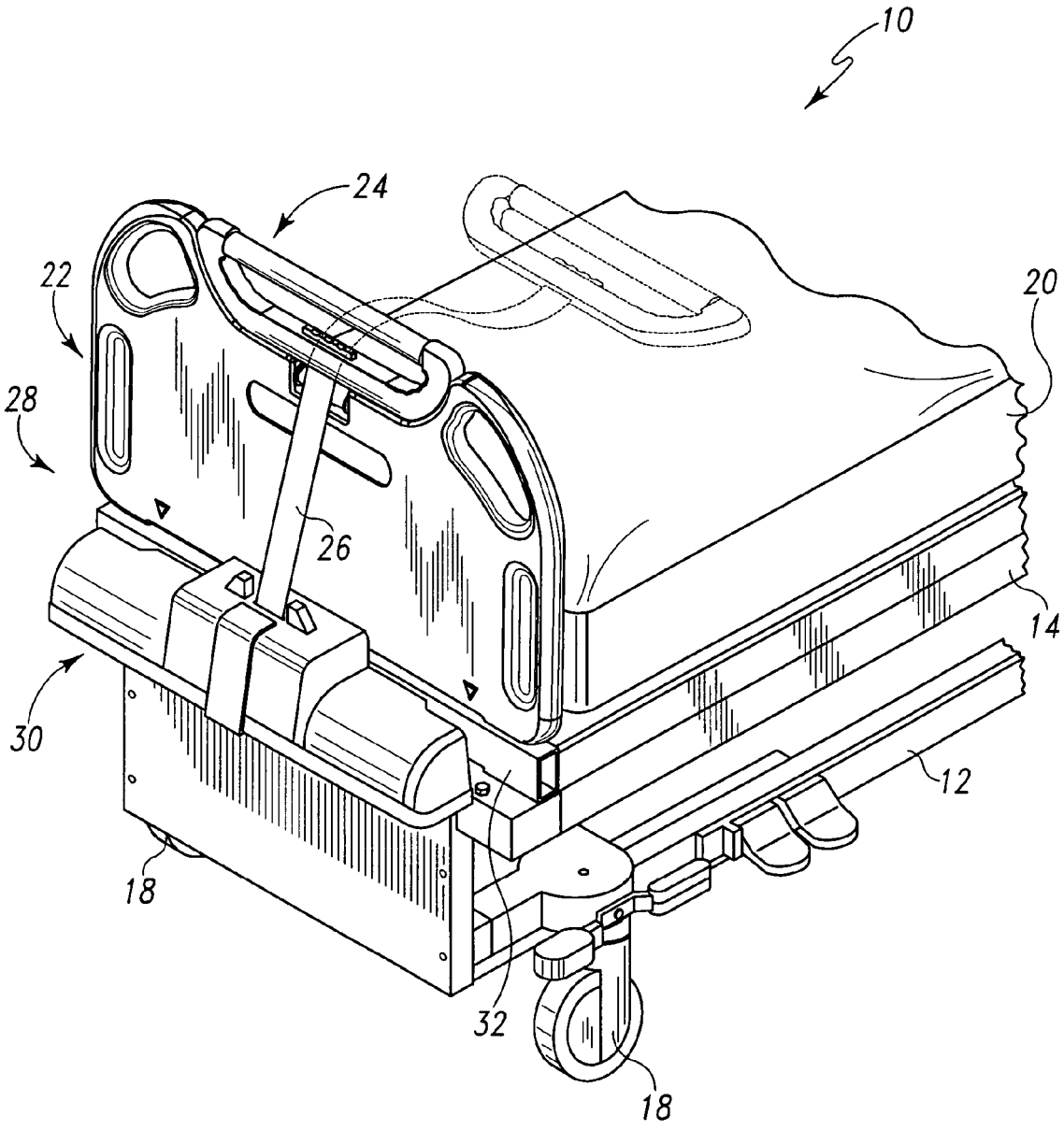
FIG. 1 is a fragmentary perspective view of a hospital bed having a pull-up-in bed system located thereon.

A patient support apparatus 10 including a pull-up-in-bed system 28 is shown in FIG. 1. The patient support apparatus 10 comprises a base frame 12, an intermediate frame 14 located on and moveable relative to the base frame 12, and an upper frame 16 located on the intermediate frame 14. A mattress 20 is located on the upper frame 16. The base frame 12 is supported on multiple casters 18. A headboard mounting frame 32 is located on the base frame 12 and is configured to receive and support a headboard 22 shown located on the headboard mounting frame 32. The pull-up-in-bed system 28 comprises a retractor 30 mounted on the base frame 12, a tether 26 coupled to the retractor 30 at one end, and a sheet attachment device 24 coupled to the tether 26 at the end opposite the retractor 30.

Additional details of a pull-up-in-bed system that may be used with this headboard are provided in a related U.S. patent application titled "WIRELESS CONTROL SYSTEM FOR A PATIENT SUPPORT APPARATUS," with a Ser. No. 11/313,355, filed concurrently herewith on Dec. 21, 2005, and hereby incorporated herein by reference.

The combination of the headboard 22 and the headboard mounting frame 32 support loads exerted by the pull-up-in-bed system 28 during the repositioning of a patient on the patient support apparatus 10. The headboard 22 comprises an outer housing 64, a tubular frame 52 coupled to and contained within the housing 64, a bracket 82 coupled to the tubular frame 52, and a roller 40 supported by the bracket 82 and rotatable relative to the headboard 22.

Figure 3:
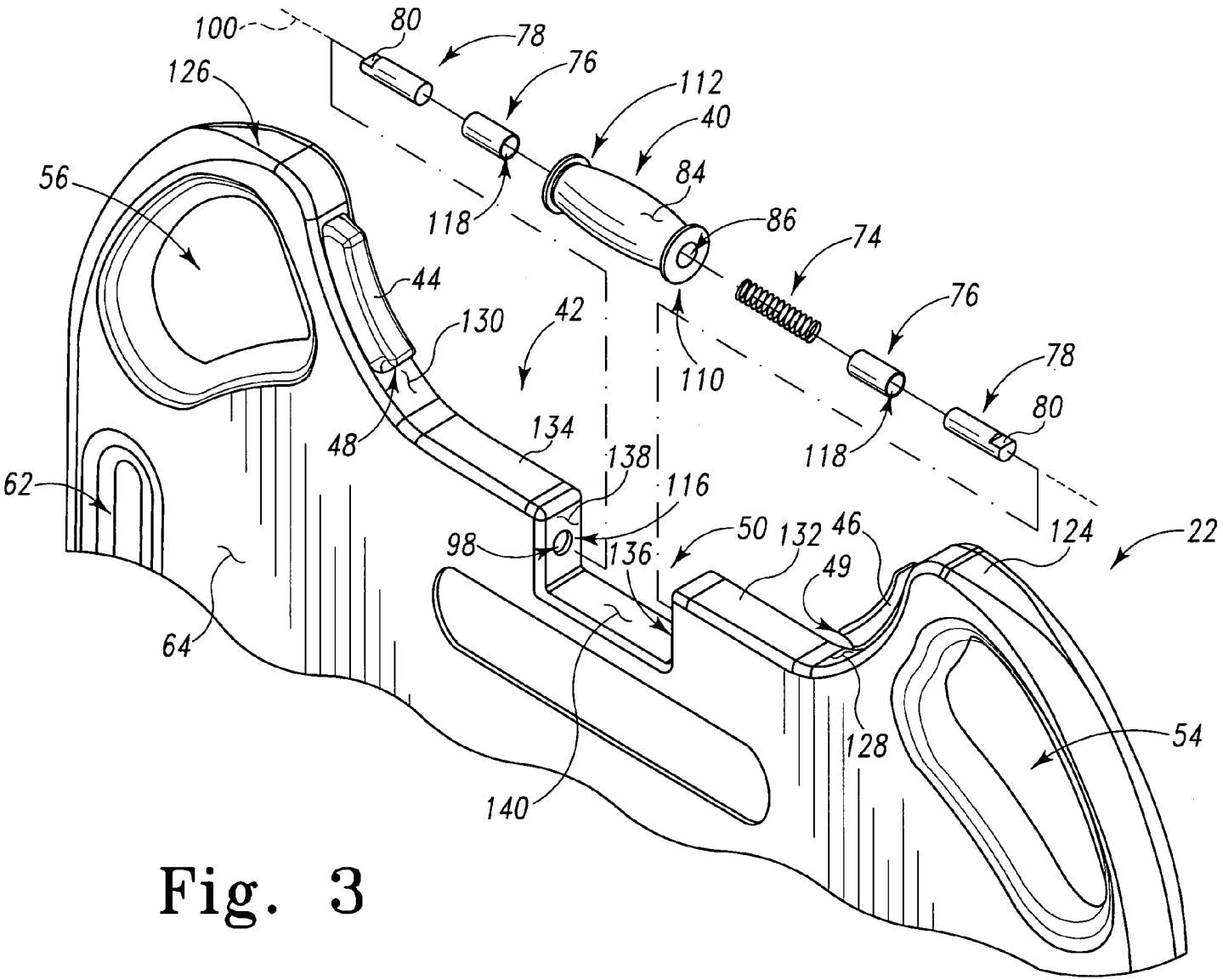
FIG. 3 is a fragmentary exploded perspective view a roller of the headboard of FIG. 2.

In some embodiments, the housing 64 is injection molded polypropylene. The housing 64 includes a large cavity 42 along the top configured to receive the sheet attachment device 24 in a stowed position as shown in FIG. 1. Referring to FIG. 3, the cavity 42 is intersected by two upper surfaces 124, 126. The headboard has sloping surfaces 128, 130 and horizontal surfaces 132, 134 that defines cavity 42. Centered in cavity 42 is a notch or smaller cavity 50 which is a U-shaped cavity bounded by two side surfaces 136, 138 and a lower surface 140. The side surfaces 136, 138 of the cavity 50 include two apertures 114, 116 communicating through a wall of the housing 64.

The sloping surface 130 has an elongated protrusion or lug 44 which extends outwardly from sloping surface 130. In a similar manner, the sloping surface 128 has an elongated protrusion or lug 46 which extends outwardly from the sloping surface 128. Protrusion 44 has a lower edge 48 which engages a retaining pin (not shown) of the sheet attachment device 24, the retaining pins being biased to extend and contact the lower edge 48 of protrusion 44 until the retaining pin is retracted by a user activating a retraction mechanism. Similarly, protrusion 46 has a lower edge 49 which is engaged by a retaining pin in a cavity on the opposite side of the sheet attachment device 24. Thus, retaining pins of the sheet attachment device 24 extend beneath lugs 44, 46 to prevent the sheet attachment device 24 from being lifted upwardly out of cavity 42. In some embodiments, the retracting pins may not engage the lower edges 48, 49 of lugs 44, 46 but may be spaced therefrom by a slight amount. Of course, after the retracting pins of the sheet attachment device are retracted by a user, the user may lift the sheet attachment device upwardly from cavity 42. The sheet attachment device 24 has pockets (not shown) that receive lugs 44, 46 to further retain the sheet attachment device 24 in place relative to headboard 22.

The housing 64 further includes two hand holes 54 and 56 which provide relief for the hand of a caregiver such as a nurse, for example, to grip the headboard 22 when the headboard 22 is used as a handle to move the patient support apparatus 10. Additionally, the housing 64 includes depressions 62 in the main surface of the housing 64, the depressions 62 are configured and located so as to provide stiffening of the headboard 22 to minimize deflection of the headboard 22. The headboard 22 supports forces exerted by the pull-up-in-bed system 28 during the operation of the pull-up-in-bed system 28 or the forces exerted on the headboard 22 while a caregiver utilizes the hand holes 54 and 56.

Figure 2:
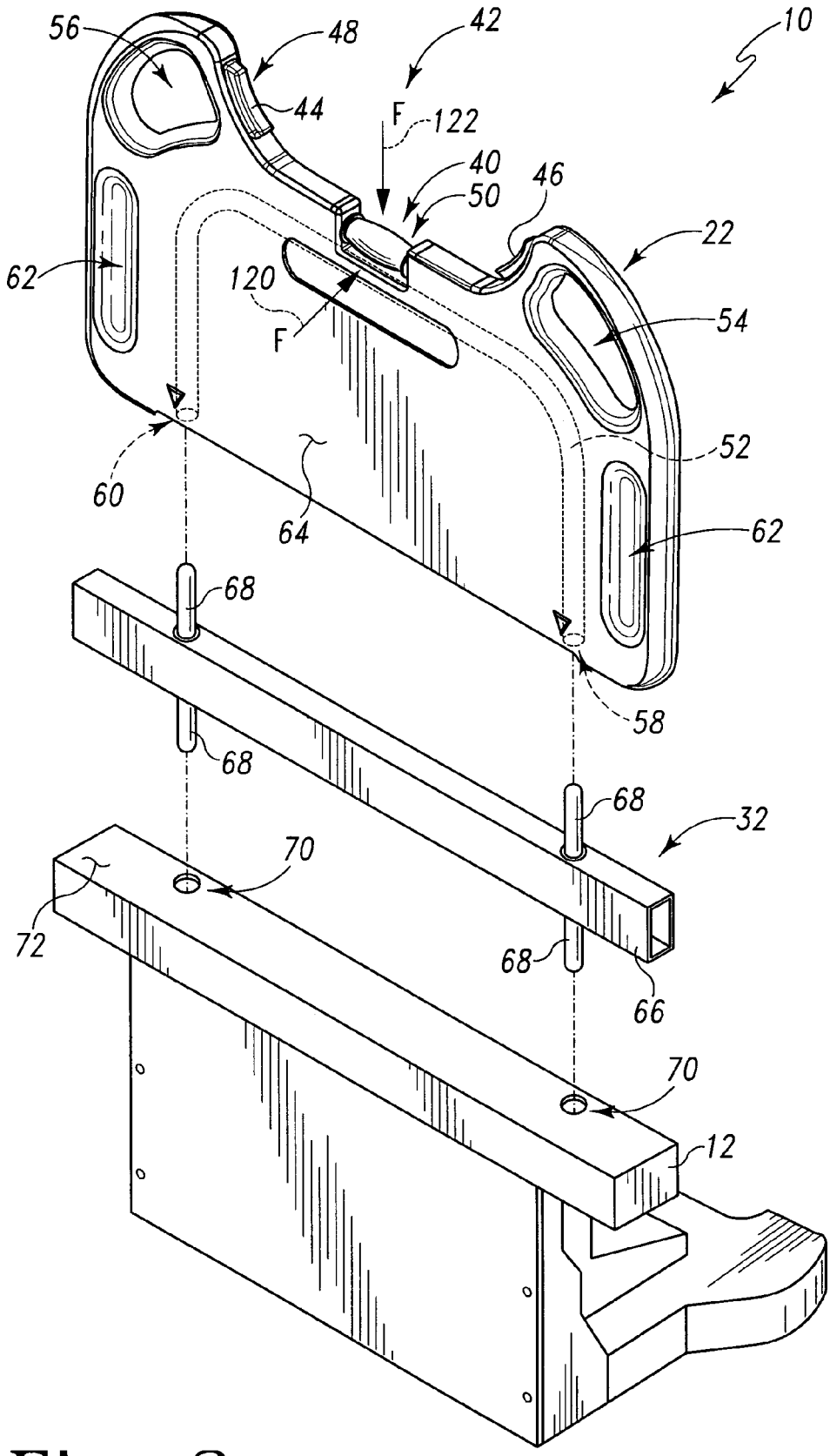
FIG. 2 is a fragmentary exploded perspective view of a head end of the hospital bed of FIG. 1 showing the mounting of a headboard and a headboard adapter to the frame of the hospital bed.

The tubular frame 52, shown in phantom in FIG. 2, is a U-shaped steel tube with each end of the tube having respective apertures 58 and 60 open at the bottom of the housing 64. The tubular frame may be steel, aluminum, or other material of sufficient strength to support the loads applied to the headboard 22 by the pull-up-in-bed system 28. The apertures 58 and 60 engage a respective mounting post 68 of the headboard mounting frame 32. The inside diameter of the apertures 58, 60 is just slightly larger than the outside diameter of the mounting posts 68 so that receipt of the mounting posts 68 in the apertures 58, 60 of the tubular frame 52 results in the mounting posts 68 providing structural support to the headboard 22. Thus, the bottom portions of the tubular frame 52 serve as sockets that receive mounting posts 68. The headboard mounting frame 32, including the mounting posts 68, may be made of metal such as steel or aluminum, or other material sufficient to support the loads applied to the headboard 22 by the pull-up-in-bed system 28.

Figure 4:
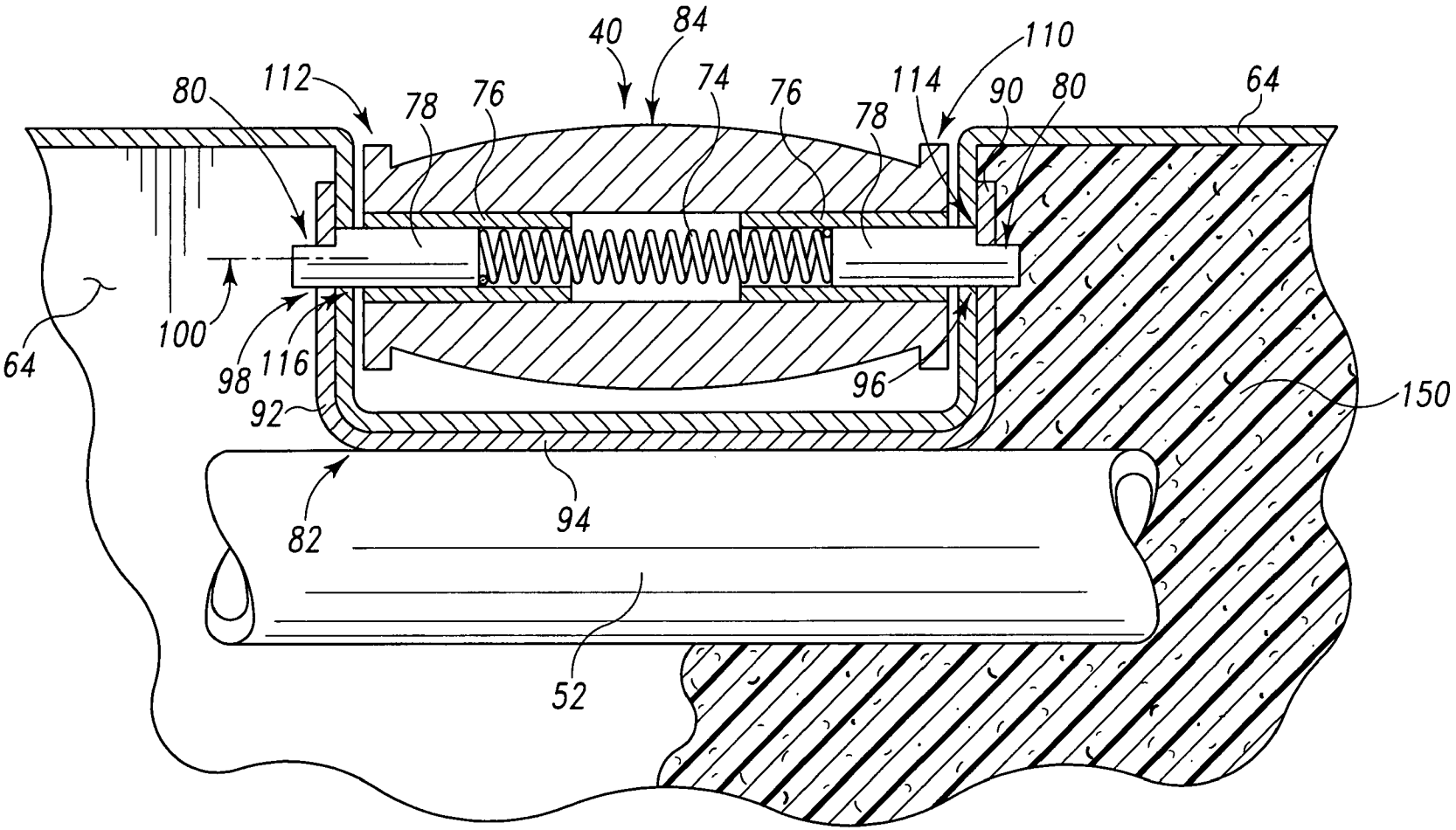
FIG. 4 is a fragmentary cross-sectional view of the roller and headboard of FIG. 3.

Referring now to FIG. 4, the bracket 82 is coupled to the tubular frame 52 at the top of the tubular frame 52 and is centered laterally relative to the housing 64. The bracket 82 has a main portion 94 and two leg portions 90, 92 which extend perpendicularly from the main portion 94 and parallel to one another. Each of the leg portions 90, 92 have a non-circular aperture 96, 98, with the respective non-circular apertures 96, 98 communicating through the leg portions 90, 92. The voids within the housing 64 are filled with a structural foam 150 such as a polyurethane based structural foam. The structural foam 54 provides additional rigidity to the headboard 22 when forces are applied by a caregiver or the pull-up-in-bed system 28.

The apertures 96, 98 receive and support the pins 78. In the illustrative example, respective flat surfaces 80 at the ends of the pins 78 extending through each leg portion 90, 92 such that pins 78 are supported by the leg portions 90, 92 in a cantilevered manner. The pins 78, in turn, support the roller 40. Referring now to FIG. 3, the roller 40 is generally annularly shaped about a central axis 100. The roller 40 has a cylindrically shaped bore 86 which traverses the length of the roller 40 and is centered on the axis 100. The roller 40 has a generally convex outer surface 84 which is symmetrical about axis 100. As seen in the cross-sectional view of FIG. 4, the outer surface 84 is parabolic and intersects two annular flanges 110, 112 on either end of the longitudinal length of the roller 40. As the tether 26 passes over the roller 40, the shape of outer surface 84 tends to urge the tether 26 to center on the longitudinal length of the roller 40. The flanges 110, 112 prevent the tether 26 from slipping off of the roller 40.

The cylindrical bore 86 of the roller 40 is sized to receive the outer diameter of two bushings 76 with an interference fit. The bushings 76 are inserted into the bore 86 such that the bushings 86 are flush with the outer end surfaces of the roller 40. The inner diameter of the bushings 76 are sized to receive a respective end of an extension spring 74. The inner diameter of the bushings 76 are also sized to receive the outer diameter of the pins 78. Each pin 78 is inserted into the associated bushing 76 from an outer end thereof with the end of each pin 78 having the flat surface 80 extending away from the roller 40. The pins 78 each engage the spring 74 so that the spring 74 is maintained in a state of compression to bias the pins 78 apart.

The entire assembly of roller 40, spring 74, bushings 76, and pins 78 are situated in the cavity or notch 50 with the pins 78 extending through two apertures 114 and 116 provided in housing 64 on either side of cavity 50 and into the apertures 96, 98 provided in the leg portions 90, 92, respectively. The bias of the spring 74 urges pins 78 into the apertures 96, 98. Insertion of the assembly is accomplished by comprising spring 74 sufficiently to allow the pins 78 to pass between leg portions 90, 92 until the pins 78 engage apertures 96, 98.

Figure 5:
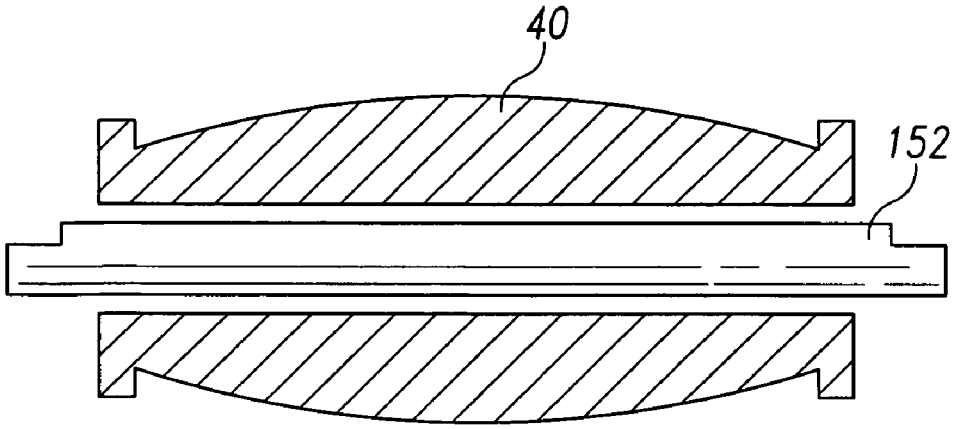
FIG. 5 is a cross-sectional view of another embodiment of the roller having a solid pin therethrough.
Figure 6:
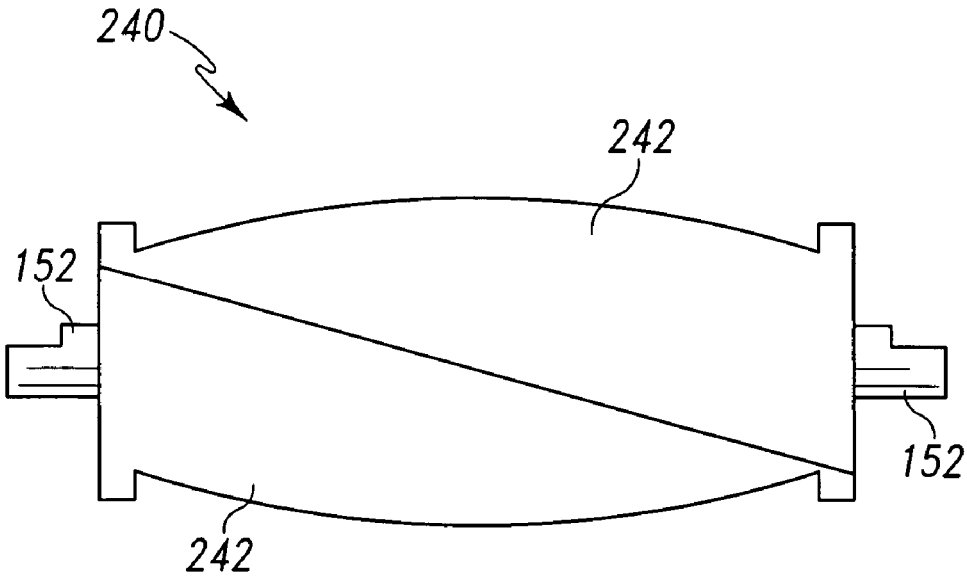
FIG. 6 is a front view of another embodiment of a roller.

In another embodiment, shown in FIG. 5, the pins 78, bushings 76, and spring 74 may be omitted and replaced with a single pin 152 which traverses the entire length of the cylindrical bore, the pin having non-circular cross-sections at either end to engage the non-circular apertures 96, 98. In still another embodiment shown in FIG. 6, the roller 40 has been replaced by a roller assembly 240 which comprises two roller halves 242 which are secured together to form the roller assembly 240. In the illustrative embodiment of FIG. 6, the pin 152 is utilized. This allows for the assembly of the pin 152 to the bracket 82 and subsequently assembling the roller assembly 240 about the pin 152. The roller assembly 240 of the illustrative embodiment of FIG. 6 is coupled together by an adhesive. In other embodiments, the roller halves 242 may be coupled by a fastener, ultrasonic welding, and the like. While the illustrative embodiment of FIG. 6 shows the roller half 242 being split along a longitudinal length at an angle to the centerline of the roller assembly 240, it should be understood that any of a number of pieces having any of a number of configurations may be used to form roller assembly 240.

Referring again to FIG. 4, the inner diameter of the bushings 76 form a cylindrical surface 118 which serves as a bearing surface between the bushings 76 and the pins 78, the surface 118 facilitating rotation of the bushings 76 about axis 100 relative to the pins 78. The pins 78 are restrained from rotation by the engagement of flat surface 80 to the apertures 96 and 98. The bushings 76 and thereby the roller 40 are supported on the pins 78 and are free to rotate on pins 78 about axis 100.

The forces experienced by roller 40 are transmitted through the pins 78 to the bracket 82 which, in turn, transfers the forces to the tubular frame 52. Referring again now to FIG. 2, the forces supported by tubular frame 52, are transferred to the mounting pins 68 of the headboard mounting frame 32. When the pull-up-in-bed system 28 is used, the roller 40 is subjected to forces as represented by two arrows 120, 122 in FIG. 2. The vertical force 122 is transferred directly to the headboard mounting bracket 32 and is borne by a member 66 of the headboard mounting bracket 32. The horizontal force 120 results in a shear force on the mounting pins 68 of the headboard mounting bracket 32. The headboard mounting bracket 32 is engaged to the base 12 of the patient support apparatus 10 by the engagement of two mounting pins 68 to two apertures 70 in a surface 72 of the base 12.

Although certain illustrative embodiments have been described in detail above, variations and modifications exist within the scope and spirit of this disclosure as described and as defined in the following claims.

The invention claimed is:

1. A headboard for use with a pull-up-in-bed system having a tether and a patient support apparatus having a base frame and an upper frame, the headboard comprising a frame configured to couple to the patient support apparatus, a bracket coupled to the frame, and a pin fixed to the bracket such that the pin does not rotate relative to the bracket; and a roller supported on the pin and configured to receive the tether of the pull-up-in-bed system when the tether is placed over the headboard, the roller free to rotate relative to the pin as the tether moves over the headboard during operation of the pull-up-in-bed system.

2. The headboard of claim 1, wherein the pin includes a portion having a non-circular cross-section and the bracket includes an aperture with a non-circular shape complementary to the non-circular cross-section of the pin.

3. The headboard of claim 1, further comprising a pin that is biased to engage the bracket and the roller is supported by the pin and rotatable relative to the pin.

4. The headboard of claim 3, further comprising a spring biasing the pin to engage the bracket.

5. The headboard of claim 1, wherein the roller has a convex annular surface.

6. The headboard of claim 5, wherein the convex annular surface has a parabolic profile along a length of the roller.

7. The headboard of claim 1, wherein the roller includes first and second portions that are coupled together over the pin, each portion including a channel configured to receive the pin such that when the portions are coupled the channels cooperate to define an internal cylindrical surface about the pin.

8. The headboard of claim 1. further comprising a housing enclosing the frame and the bracket.

9. The headboard of claim 8, wherein the housing has at least one void filled with structural foam.

10. The headboard of claim 8, wherein the housing is formed to include handles.

11. The headboard of claim 10, wherein the handles are configured to be used by a caregiver to push the patient support apparatus.

12. A headboard for use with a bed and a pull-up-in-bed system having a tether, the headboard comprising:

a housing having an upper surface, a structure comprising (i) a U-shaped bracket coupled to a frame of the patient support apparatus, the U-shaped bracket including a main portion and a first and second extended portions extending from the main portion, each extended Portion having an aperture therethrough, the apertures aligned along an axis of rotation, and (ii) a pin engaged with the aperture such that the axis of the pin is substantially coincident with the axis of rotation, and a roller supported on the pin, the roller being exposed along the upper surface of the housing and adapted to interface with the tether such that the tether overlies both the housing and the roller when the pull-up-in-bed system is engaged such that the roller is free to rotate as the tether moves over the roller.

13. The headboard of claim 12, wherein the roller is situated in a notch formed along the top surface of the headboard.

14. The headboard of claim 12, wherein the roller comprises multiple portions coupled together over a portion of the structure, each portion of the roller including a channel configured to receive the structure such that when the portions are coupled, the channels cooperate to define an internal surface in the roller in which the portion of the structure is positioned.

15. The headboard of claim 12, further comprising a second pin opposite the first pin, a spring engaging the first and second pins to urge the pins apart, and a bushing interposed between the roller and the pins and spring such that the bushing is supported on the pins to permit rotation of the roller relative to the pins and spring.

16. The headboard of claim 14, wherein the pins are coupled to the bracket preventing rotation of the pins relative to the bracket.

17. The headboard of claim 12, wherein the roller includes a convex external surface along the length of the roller.

* * * * *